US007066794B2

(12) United States Patent
Granziera et al.

(10) Patent No.: US 7,066,794 B2
(45) Date of Patent: Jun. 27, 2006

(54) TOOL FOR FINE MACHINING OF OPTICALLY ACTIVE SURFACES

(75) Inventors: Gilles Granziera, Pontarme (FR); Reiner Herold, Schoffengrund/Oberquembach (DE); Peter Philipps, Dillhausen (DE); Karl-Heinz Troβ, Ehringshausen (DE)

(73) Assignee: Satisloh GmbH, Wetzlar (DE)

( * ) Notice: Subject to any disclaimer, the term of this patent is extended or adjusted under 35 U.S.C. 154(b) by 250 days.

(21) Appl. No.: 10/834,720

(22) Filed: Apr. 29, 2004

(65) Prior Publication Data

US 2004/0224619 A1 Nov. 11, 2004

(30) Foreign Application Priority Data

May 2, 2003 (DE) ..... 103 19 945

(51) Int. Cl.
*B24B 49/00* (2006.01)

(52) U.S. Cl. ..... 451/158; 451/277; 451/495

(58) Field of Classification Search ..... 451/41, 451/42, 158, 255, 256, 277, 323, 495, 390
See application file for complete search history.

(56) References Cited

U.S. PATENT DOCUMENTS 4,802,309 A * 2/1989 Heynacher ..... 451/41
5,255,474 A 10/1993 Gawa et al.
5,421,770 A 6/1995 Bobst
5,695,393 A 12/1997 Granziera
6,932,678 B1 * 8/2005 Toyoshima et al. ..... 451/42
2003/0045211 A1 3/2003 Kuebler
2005/0037695 A1 * 2/2005 Kuebler ..... 451/41

FOREIGN PATENT DOCUMENTS

DE 101 06 659 A1 8/2002
WO WO 00/00324 A 1/2000

* cited by examiner

*Primary Examiner*—Jacob K. Ackun, Jr.
(74) *Attorney, Agent, or Firm*—Reising, Ethington, Barnes, Kisselle, P.C.

(57) ABSTRACT

A tool (10) is disclosed for fine machining of optically active surfaces (F), with a base body (12) that can be attached to a tool spindle of a machine tool, and an elastic membrane (14) that has a machining section (16) to which connects a gaiter section (18) by means of which the membrane is attached to the base body such that it can be rotated therewith. The base body and the membrane delimit a pressure medium chamber (20) which via a channel (22) can be optionally pressurized with a pressure medium in order to apply a machining pressure via the machining section during machining of the optically active surface. A guide element (24) guided longitudinally mobile on the base body is actively connected with the machining section so that the machining section can be moved in the longitudinal direction of the guide element and held in the transverse direction to the guide element, although under an elastic deformation of the gaiter section it is tilt-mobile in relation to the guide element. The result is a tool of simple design and reliable function which has an excellent adaptability to a wide range of geometries to be machined.

26 Claims, 3 Drawing Sheets

TOOL FOR FINE MACHINING OF OPTICALLY ACTIVE SURFACES

BACKGROUND OF THE INVENTION

The present invention relates to a tool for fine machining of optically active surfaces such as is used for example in lens production in fine machining of optical lenses. In particular the invention relates to a tool for fine machining of free form surfaces and toric surfaces on spectacle lenses.

When the description below uses the term "spectacle lenses" as an example of optical workpieces, these refer not only to spectacle lenses of mineral glass but also to spectacle lenses of all other conventional materials e.g. polycarbonate, CR 39, HI index, etc. i.e. also plastics.

Cutting machining of optically active surfaces of spectacle lenses can be roughly divided into two phases, namely first the pre-machining of the optically active surface to generate the prescription macro-geometry, and then the fine machining of the optical active surface to remove the traces of pre-machining and obtain the desired micro-geometry. Whereas pre-machining of the optically active surfaces of spectacle lenses, depending amongst others on the material of the spectacle lenses, takes place by grinding, milling and/or turning, the optically active surfaces of spectacle lenses in fine machining are usually subjected to a fine grinding, lapping and/or polishing process. Mainly rigid forming tools are used here which serve as a support for fine grinding films or polishing compound carriers.

The prior art has repeatedly found (e.g. DE 44 42 181 C1, EP 0 884 135 B1, DE 101 06 007 A1) that a disadvantage of rigid forming tools is that a large number of forming tools is required to fine machine the multiplicity of possible lens geometries occurring in prescription production of spectacle lenses (convex or concave curvatures from 0 to 17 diopters, where applicable with cylinder effect with up to 6 diopters) with possibly deviating refractive indices of the various materials. Further difficulties occur in the trend for spectacles to use increasingly multi-focal lenses in the form of progressive focal lenses in which the distance vision area transforms progressively into the near vision area. At least one of the optically active surfaces of such spectacle lenses has an individually designed macro-geometry which also has free form surfaces and naturally must also be fine machined.

In the prior art there is no lack of suggestions of how tools should be designed for fine machining of optically active surfaces in order to cover as wide as possible a range of geometries with one tool.

In this context DE 44 42 181 C1 by the applicant discloses a tool for fine machining of optical surfaces of lenses, with an elastic membrane having a machining section which is attached via a fixing section to a rigid holder. The rigid holder together with the elastic membrane delimits a cavity filled with a filling material which, as a mass deformable plastically under certain conditions, forms optionally under control a flexible or rigid supporting layer for the membrane so that before the start of the fine machining the outer contour of the membrane can be adapted to the form of the optical surface. According to this prior art the membrane furthermore has between its machining section and its fixing section a gaiter-like section which, on contact of the machining section with the optical surface, applies forces to the plastically deformable mass so that this presses the machining section onto the optical surface so that the tool retains its shape after hardening of the plastically deformable mass. Using this tool a relatively wide range of lens geometries can be fine machined. The softening and subsequent hardening of the plastically deformable mass however requires some time, so that this tool can only be used with restrictions in industrial production of prescription lenses.

In other solutions (EP 0 884 135 B1, DE 101 06 007 A1) in which the tool is also able to form the surface to be fine machined before this machining, the tool has two axially spaced elastic membranes held on a base body, between which is provided a multiplicity of pins which can be moved in the longitudinal direction by pneumatic action on the membrane inside the tool in order to adapt the membrane outside the tool to the surface to be fine machined. When this adaptation is made, the pins are fixed to each other pneumatically or magnetically in the transverse direction in order to form a rigid machining surface on the tool. One particular problem with these tools however is that these tools are very complex in design and consequently susceptible to fault.

Finally tools for polishing optical surfaces are also known (DE 101 00 860 A1, DE 101 06 659 A1) which have a rigid base body that is connected articulated and rotationally rigid with the tool spindle and on the machining side carries an elastic intermediate layer and on this the polishing layer itself. These tools can naturally only be adapted to the optical surface to be fine machined insofar as the elastic intermediate layer permits it which, to ensure control of the polishing process, cannot be formed arbitrarily thick.

To summarize it can be found that there is still a need for an adaptable tool for fine machining especially of spectacle lenses which can be used as universally as possible in the industrial production of prescription spectacle lenses, is economic and at the same time reliably guarantees good machining results.

SUMMARY OF THE INVENTION

The invention consequently is based on the object of creating a tool designed as simply as possible with reliable function for fine machining of optically active surfaces, in particular free form surfaces and toric surfaces on spectacle lenses, which has good adaptability to a wide range of geometries to be machined.

This object is solved by the features indicated in claim 1. Advantageous and/or suitable developments of the invention are the subject of claims 2 to 21.

According to the invention a tool for fine machining of optically active surfaces, in particular free form surfaces and toric surfaces on spectacle lenses, has a base body that can be attached to a tool spindle of a machine tool, an elastic membrane that has a machining section followed by a gaiter section by means of which the membrane is attached to the base body so that it can be rotated therewith, a pressure medium chamber that is delimited by the base body and the membrane and selectively can be pressurized with a pressure medium via a channel in order to apply a machining pressure via the machining section during machining of the optically active surface, and a guide element guided longitudinally mobile on the base body that is actively connected with the machining section of the membrane so that the machining section is mobile in the longitudinal direction of the guide element and held in the transverse direction to the guide element, although it is tilt-mobile in relation to the guide element under an elastic deformation of the gaiter section.

Because of the pressurisability of the elastic membrane via the pressure medium chamber, the axial mobility of the machining section of the membrane guided by the guide element, its tilt-mobility in relation to the guide element and the elastic deformability of the gaiter section of the membrane, the tool according to the invention can be adapted excellently to the geometry of the surface to be fine machined. At the same time the guide element of the tool according to the invention, by holding the machining section of the membrane in the transverse direction, ensures excellent guidance of the machining section close to the surface to be fine machined as the guide element is actively connected with the machining section so that the torsional and transverse forces necessary for machining can be reliably transferred to the surface to be fine machined while undesirable tilting forces are avoided. This excellent adaptability of the tool and very good guidance of the machining section of the membrane are not reduced by the torque transfer—necessary in any case—from the base body of the tool to its membrane as this torque transfer takes place via the gaiter section of the membrane i.e. functionally separately from the guide element. Also finally no complex construction of the tool is required. As a result of the design of the tool according to the invention, the tool can firstly adapt to virtually arbitrary geometries or curvatures of the surfaces to be fine machined and secondly reliably transfer the process forces necessary for machining for example to a fine grinding or polishing film. Also the tool is able to eliminate kinematic roughness of the pre-machined surface e.g. turning or milling grooves, by smoothing the structure.

In principle it is possible to form the machining section of the membrane so that it is flat when the membrane is without load. Preference is given however to a design in which the machining section of the membrane is preformed essentially spherical (convex or concave depending on requirements), which can easily be achieved on vulcanizing or casting of the membrane and whereby the machining section of the membrane can adapt even better to the surface to be fine machined.

Tests by the applicant have furthermore shown that a gaiter section of the membrane with at least two folds has a deformation capacity suitable for the purposes of the present invention. To achieve a good compromise between adaptability and dimensional stability of the tool, the gaiter section preferably has three folds. Suitably the membrane can be comprised of an elastomer material, in particular NBR, EPDM or PUR with a Shore A hardness of 45 to 70, preferably 55 to 60.

In an advantageous embodiment of the invention it can be provided that the machining section of the membrane is stiffened by means of an areal reinforcement. This measure compensates in particular for the long wave unevenness which can result from the pre-machining structures (kinematic roughness in the form of turning or milling grooves), due to the greater removal of the raised parts of the turning or milling structure, whereby the fine machined surface is smoothed. Also the reinforcement ensures a better pressure distribution during fine machining. The reinforcement can essentially be preformed spherical which—compared with a flat form of the reinforcement which is also possible—ensures better deformability of the reinforcement and hence better adaptability of the machining section of the membrane to the surface to be machined.

In principle it is possible to vulcanize the reinforcement into the machining section of the membrane during its production, or to glue the reinforcement to the machining section of the membrane from the outside or inside. Preference is given however to a design in which the reinforcement is vulcanized onto the side of the machining section of the membrane facing away from the pressure medium chamber.

In a further embodiment it can be provided that the reinforcement is comprised of a plastically deformable, metallic sheet section in particular a sheet section of a TiZn-based alloy. Use of such sheet metal as reinforcement prevents the machining section of the membrane from returning to its original shape, as it tries to do in principle because of its formation from elastomer material, whereby it is possible advantageously to deform the surface to be machined by means of the reinforced machining section in a manner sustainable at least during the fine machining process.

For better adaptation to non-rotationally symmetrical, especially toric surfaces, in particular those with high cylinder power i.e. great discrepancy between the base and cylinder curves, the reinforcement of the machining section can also have different flexional rigidities in two planes running perpendicular to each other or in the directions of the base and cylinder axes of the torus. This can for example be achieved if the reinforcement in a cross-like arrangement has four sets of slots essentially parallel in each set, which extend from the edge of the reinforcement towards the inside and there end at a slot-free area of the reinforcement which essentially has the form of a "X" curved inwards on both sides, whereby the slots in the one direction on average have a different length from the slots in the direction perpendicular to this.

Furthermore on the machining section of the membrane on the side facing away from the pressure medium chamber can be applied an elastic intermediate layer which is comprised of a suitable elastomer material for example a PUR foam and has a Shore A hardness of 35 to 60, preferably 45 to 50. Such an intermediate layer is suitable in particular for the fine machining of free form surfaces (FFF), in order to be able to polish out well surface transitions e.g. in progressive focus lenses for spectacles, the transition from the distance vision area to the near vision area.

The guide element for guiding the machining section of the membrane can e.g. be formed by a sleeve which is guided on a complementary peg formed or attached to the base body. However preference is given, especially from production aspects, to a design in which the guide element is formed by a pin which is guided longitudinally mobile in a receiving bore in the base body.

In order to achieve the maximum smoothness of guidance, between the guide element and the base body can be provided means for reducing friction. Here for example conventional slide bearings, slide bushes of e.g. PTFE or ball sockets can be used. In a preferred embodiment the receiving bore in the base body has at least one grease pocket as a means of reducing friction.

In principle it is possible for the channel for pressurization of the pressure medium chamber to pass through the actual base body of the tool as a bore. Preferably the channel for pressurization of the pressure medium chamber however is formed in the guide element. Here especially for production reasons it has proved suitable to form the channel with a longitudinal bore in the guide element which communicates with the pressure medium chamber via a transverse bore in the guide element.

For the active connection between the guide element and the machining section of the membrane, different forms of articulated connection are possible which enable the machining section to execute universal compensation movements. Preference is given here to an active connection in which the guide element is actively connected with the machining section of the membrane via a ball head held swivellably in a ball socket. The ball socket can be formed by a shaped part which is linked into an undercut receiving chamber formed on the machining section of the membrane on the side facing the pressure medium chamber.

If finally the receiving chamber on the machining section of the membrane can communicate with the channel for pressurization of the pressure medium chamber via a channel extending through the ball head, it is advantageously possible also to apply the pressure medium to the area of the machining section of the membrane above the ball head so that this area of the machining section is also pressed individually against the optically active surface during machining.

BRIEF DESCRIPTION OF THE DRAWINGS

The invention is now explained below with reference to preferred embodiments using the enclosed drawings, where the same or corresponding parts carry the same reference signs. The drawings show.

DETAILED DESCRIPTION OF THE PREFERRED EMBODIMENTS

Figure 1:
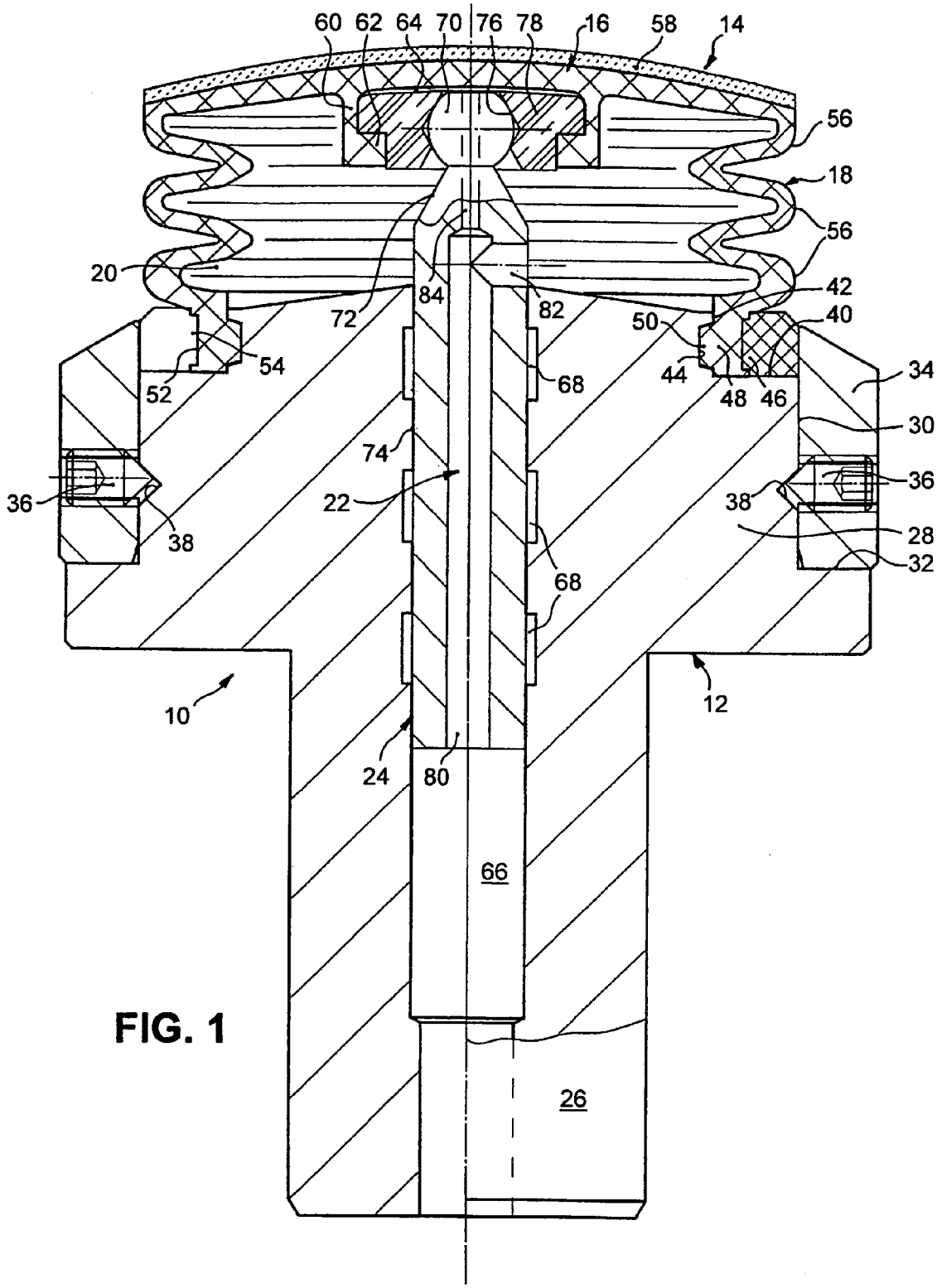
FIG. 1 a longitudinal section view of a tool for fine machining of optically active surfaces according to a first embodiment of the invention in a scale enlarged in relation to reality, FIG. 2 a longitudinal section view of a blocked spectacle lens and the tool according to the first embodiment in a smaller scale than FIG. 1, where the spectacle lens and tool are in engagement, FIG. 3 a longitudinal section view according to FIG. 2, where the spectacle lens and tool in relation to the rotary position shown in FIG. 2, are each turned further in the same direction about their longitudinal axis by a quarter turn, FIG. 4 a longitudinal section view of an elastic membrane reinforced in the area of its machining section with an areal reinforcement, for a tool according to a second embodiment of the invention in a scale enlarged in relation to reality, FIG. 5 a top view onto the membrane according to FIG. 4 along a section line IV-IV in FIG. 4, where in relation to FIG. 4 a polishing compound carrier has been removed from the membrane, and FIG. 6 a longitudinal section view of an elastic membrane fitted with an elastic intermediate layer on its machining section, for a tool according to a third embodiment of the invention in a scale enlarged in relation to reality.

According to FIG. 1 a tool 10 for fine machining of optically active surfaces F, in particular for free form surfaces and toric surfaces on spectacle lenses L, has a base body 12, which can be attached to a tool spindle (not shown) of a machine tool known in itself (also not shown). Furthermore the tool 10 has an elastic membrane 14 that has a machining section 16 attached to which is a gaiter section 18, by means of which the membrane 14 is attached to the base body 12 so that it can rotate therewith. The base body 12 and the membrane 14 delimit a pressure medium chamber 20 of the tool 10 which via a channel 22 can be pressurized optionally with a suitable liquid or gaseous pressure medium (e.g. oil or compressed air with a pressure of around 0.2 to 0.6 bar), in order during machining of the optically active surface F to exert a machining pressure via the machining section 16. Guided longitudinally mobile on the base body 12 is a guide element 24, which as will be described in more detail below, is actively connected with the machining section 16 of the membrane 14 so that the machining section 16 is held mobile in the longitudinal direction of the guide element 24 and fixed in the transverse direction to the guide element 24, although under an elastic deformation of the gaiter section 18 of the membrane 14 it is tilt-mobile in relation to the guide element 24.

The preferably metallic base body 12 has a fixing section 26 by means of which the tool 10 can be mounted detachably on the tool spindle (not shown), and attached to the fixing section 26 is a head section 28 on which is interchangeably attached the membrane 14. In the embodiment shown the fixing section 26 in a very simple design has a cylindrical outer peripheral surface. For automatic tool change the fixing section can however be designed as a quick-release taper connection with e.g. a hollow shaft taper according to German standard DIN 69893. Depending on the requirements it is also conceivable to structure the fixing section as a block piece connection as normal in the production of prescription spectacle lenses L and standardized in German standard DIN 58766. This connection can also where applicable be fitted with a gripping groove for any handling systems.

The head section 28 of the base body 12 has a cylindrical step 30 on which in the direction of the fixing section 26 sits a ring shoulder 32 that forms a stop surface for a preferably metallic ring part 34, which is pushed over the step 30 to fix the membrane 14 to the base body 12. The ring part 34 chamfered towards the machining section 16 of the membrane 14 is fitted with several threaded bores distributed over the periphery into which are screwed grub screws 36 that engage form fit in recesses 38 formed in the step 30 in order to hold the ring part 34 on the head section 28 of the base body 12 in a manner resistant to tension, compression and rotation.

In the direction of membrane 14, after the step 30 of the head section 28 via a further ring shoulder 40 is a further cylindrical step 42 of smaller diameter which is fitted with a radial groove 44 for a form fit fixing of the membrane 14 to the base body 12. An area protruding in the axial direction over the ring shoulder 40 of a cylindrical inner peripheral surface of the ring part 34, the ring shoulder 40 and the step 42 with the radial groove 44 of the head section 28, delimit an annular receiving chamber for a slotted ring 46 and an annular fixing end section 48 of the gaiter section 18 of the membrane 14. By means of the ring 46 preferably made of POM (polyoxymethylene, e.g. Delrin® by Dupont), the membrane 14 is attached, by form fit in the tension and pressure direction and by friction fit in the peripheral direction, i.e. rotationally fixed to the base body 12. More precisely the fixing end section 48 of the membrane 14 on the inner periphery side has a radially inwardly protruding peripheral lug 50 which engages form fit in the radial groove 44 of the step 42 on the head section 28. On the outer periphery side the fixing end section 48 is itself fitted with a radial groove 52 which engages with form fit in a peripheral lug 54 protruding radially inwards and formed on the inner periphery of the ring 46. The ring 46 itself lies with a cylindrical outer peripheral surface flat on the inner peripheral surface of the ring part 34. It is clear that the membrane 14 is thus held firmly on the base body 12 by means of the ring part 34 and the ring 46.

The membrane 14 is comprised of an elastomer material such as NBR (elastomer based on acrylonitrile-butadiene-styrene rubber), EPDM (elastomer based on ethylene-propylene-diene rubber), or PUR (polyurethane) elastomer (e.g. Vulkollan® by Bayer), with a Shore A hardness of 45 to 70, preferably 55 to 60. In the area between the fixing end section 48 and the machining section 16, the membrane 14 according to the embodiment shown has three folds 56, where the last i.e. the upper fold 56 starting from the base body 12 transforms directly into the machining section 16 of the membrane 14. The machining section 16 of the membrane 14 in the embodiment shown is circular viewed in a top view from above in FIG. 1 and, as the section view shows, has an essentially spherical preformation so that the machining section 16 curves away from the base body 12.

On the outside of the machining section 16 of the membrane 14 facing away from the pressure medium chamber 20 is glued an elastic, abrasion-resistant fine grinding or polishing compound carrier 58 also called a "polishing pad", as available commercially. On the inside of the machining section 16 of the membrane 14 facing the pressure medium chamber 20, the machining section 16 has a hollow cylindrical extension 60 formed essentially centrally of one piece with the membrane 14, which on its free end has a collar 62 protruding radially inwards so that the extension 60 together with the collar 62 delimits an undercut receiving chamber 64.

In the embodiment shown in FIG. 1 the guide element 24 is furthermore formed by a pin which is guided longitudinally mobile and rotatable in a central receiving bore 66 in the base body 12 which extends in the longitudinal direction through the entire base body 12. To reduce friction between the guide element 24 and the receiving bore 66, in the embodiment shown three grease pockets 68 are placed in the receiving bore 66 in the form of radial grooves evenly spaced in the axial direction.

At its end facing the machining section 16 of the membrane 14, the guide element 24 has a ball head 70 which is connected via a tapered transitional section 72 with a cylindrical main part 74 of the guide element 24 that is guided in the receiving bore 66. Via the ball head 70 which is held swivellable in a ball socket 76, the guide element 24 is actively connected with the machining section 16 of the membrane 14 in the manner of a ball pin joint so that the machining section 16 can execute universal compensating movements. Here the ball socket 76 is formed by a shaped part 78 which is a slotted part or as in the embodiment shown a plastic part, elastic within limits, so that the ball head 70 can be engaged in the ball socket 76. The shaped part 78 itself as is clear from FIG. 1 is engaged in the undercut receiving chamber 64 on the machining section 16 of the membrane 14, in which chamber it is held form fit by the collar 62 on the extension 60.

As is also shown in FIG. 1, the channel 22 for pressurization of the pressure medium chamber 20 is formed in the guide element 24, the channel 22 in the guide element 24 having a longitudinal bore 80 which communicates with the pressure medium chamber 20 via a transverse bore 82 close to the transitional section 72. At the end of the longitudinal bore 80 is attached a further channel in the form of a bore 84 of smaller diameter which extends through the ball head 70 of the guide element 24 so that the receiving chamber 64 on the machining section 16 of the membrane 14 can communicate with the channel 22 or in other words the receiving chamber 64 can also be pressurized with the pressure medium.

It is clear that the machining section 16 of the membrane 14 is supported by means of the guide element 24 in the transverse direction against the base body 12. Also the guide element 24 can follow the machining section 16 in the axial direction if the pressure medium chamber 20 is pressurized with pressure medium via the channel 22 or the machining section 16 of the membrane 14 is pressed by an external effect in the direction of the base body 12. Also the machining section 16 of the membrane 14 with the shaped part 78 engaged in the receiving chamber 64 can tilt as a whole on the ball head 70 of the guide element 24, the gaiter section 18 of the membrane 14 being deformed accordingly.

Figure 2:
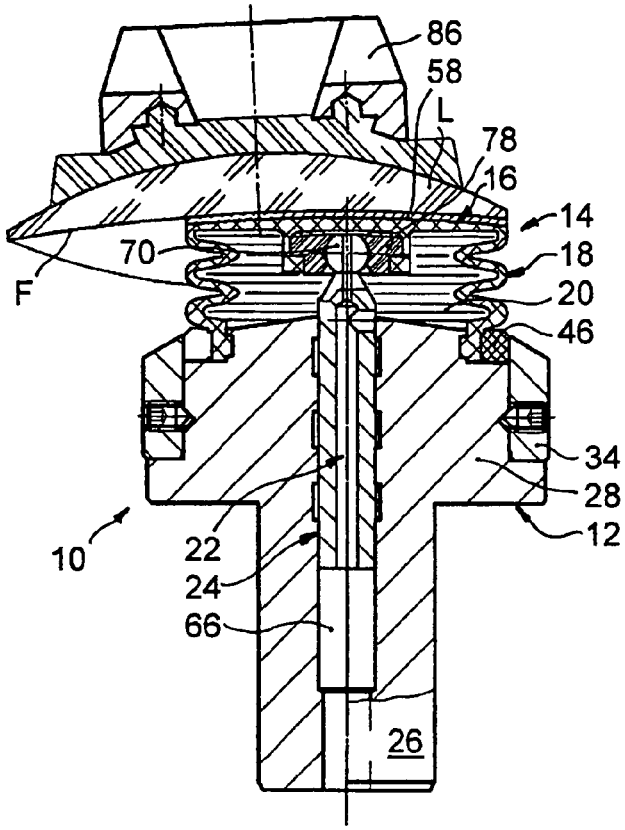
Figure 3:
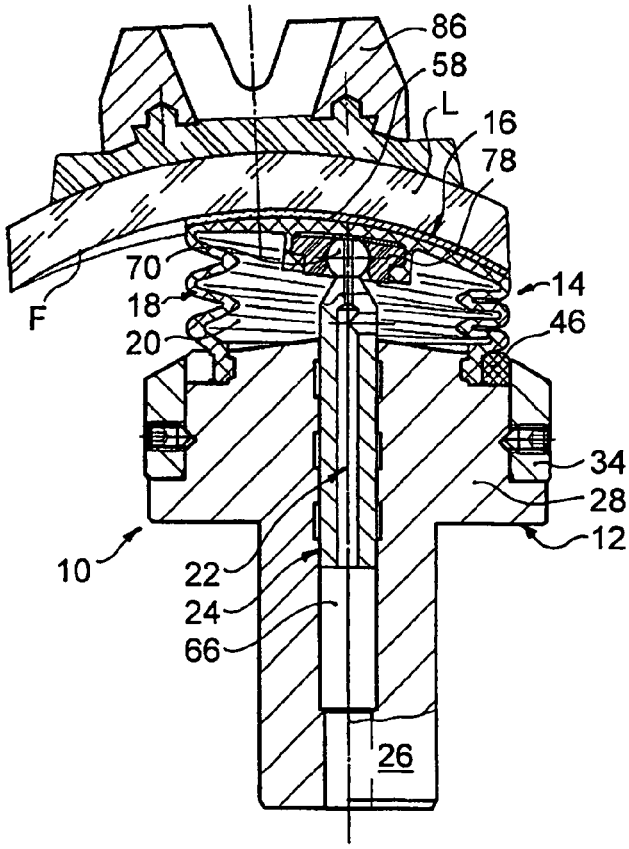

These movement possibilities of the machining section 16 of the membrane 14 are shown in FIGS. 2 and 3. Here the tool 10 with the machining section 16 of the membrane 14 is in contact with the optically active surface F to be machined of a spectacle lens L which has a toric geometry. The spectacle lens L is blocked onto a block piece 86 as known from German standard DIN 58766. In FIG. 3 in comparison with FIG. 2, the block part 86 with the spectacle lens L and the tool 10 are merely rotated further in the same direction by 90° about their respective axes without this leading to movement of the entire tool 10 or the block piece 86 in the vertical or horizontal direction and without a swivel movement between the spectacle lens L and the tool 10.

In fine machining of the optically active surface F to be machined of the spectacle lens L which takes place in the known manner by means of non-bonded grains that are supplied by means of a suitable fluid to the contact point between the tool 10 and the spectacle lens L, the tool 10 and the spectacle lens L are driven in a known manner, essentially in synchrony i.e. in the same direction and at essentially the same speed (approximately 800 to 1000 revolutions per minute), the tool 10 and the spectacle lens L being at the same time swiveled relative to each other so that the area of contact between the tool 10 and the spectacle lens L continuously changes. This fine machining process in which, in the case of machining of free form surfaces, the swivel movement takes place in a fixed setting about the center point of a "best fit radius" i.e. an approximate center point of the surface F to be machined of the spectacle glass L, or the relative movement between the tool 10 and the spectacle lens L is generated by a track-controlled process in two CNC linear axes and one CNC swivel axis, has been known to the person skilled in the art for some time and will not therefore be described in more detail at this point.

Figure 4:
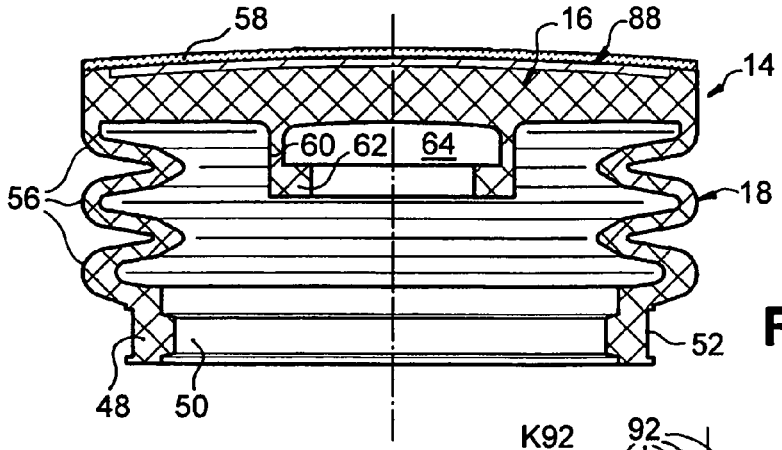
Figure 5:
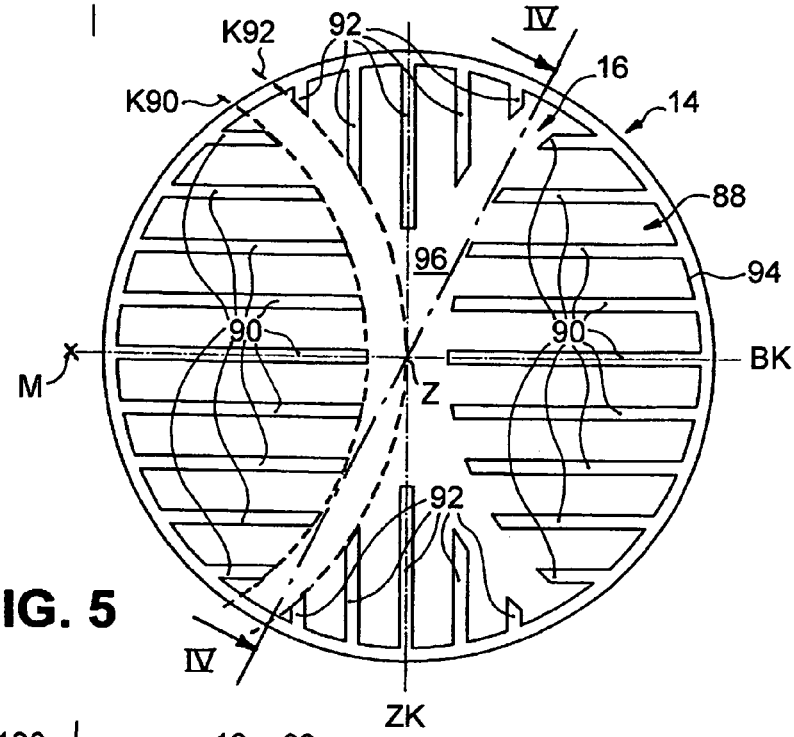
Figure 6:
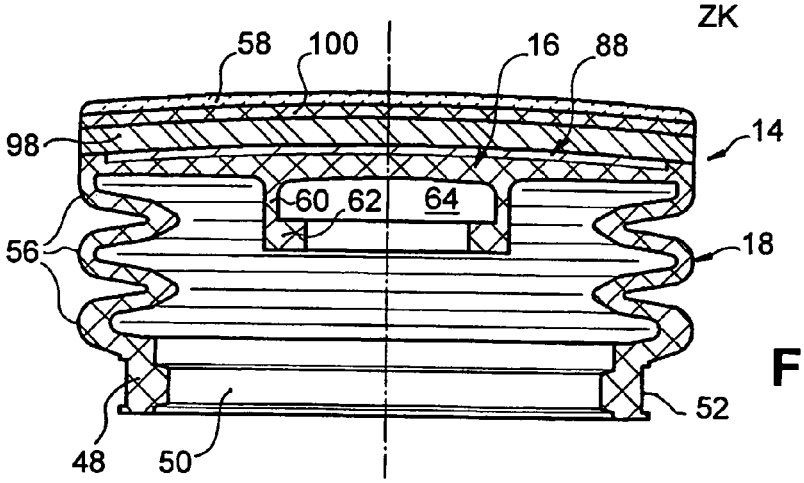

FIGS. 4 to 6 show membranes 14 for a second and third embodiment respectively of the tool 10 which will be described below insofar as they differ from the first embodiment described with reference to FIGS. 1 to 3. As the structure of the tool 10 according to the second and third embodiments does not otherwise differ from the construction of the tool 10 according to the first embodiment, a repeated explanation of the further components (base body 12, guide element 24, etc.) has been omitted.

According to FIGS. 4 and 5 the machining section 16 of the membrane 14 is stiffened by means of an areal reinforcement 88 which is preformed essentially spherical according to FIG. 4 and vulcanized onto on the machining section 16 on the side of the machining section 16 of the membrane 14 facing away from the pressure medium chamber 20. The reinforcement 88 is here formed by a plastically deformable metallic sheet section which is preferably comprised of a TiZn alloy.

This reinforcement 88 achieves two main effects: firstly the reinforcement 88 stiffens the machining section 16 of the membrane 14 such that the machining section 16 is not so flexible that it can adapt to the long wave kinematic roughness which can occur if the premachining of the spectacle lens L takes place by means of turning or milling, rather it is sufficiently rigid to smooth out these roughnesses. Secondly the reinforcement 88 because of its plastic deformability is able to give the machining section 16 a preselectable geometry corresponding to the machining requirements, where the reinforcement 88 again because of its inherent rigidity prevents the machining section 16 from specifying its own geometry thanks to its shape "memory" due to its formation from an elastomer.

In the embodiment shown here the reinforcement 88 is furthermore formed especially for the fine machining of non-rotationally symmetrical, in particular toric surfaces F, as it has been given different flexional rigidities in two planes running perpendicular to each other. This as shown in FIG. 5 would be achieved by a cross-shaped arrangement of four sets of slots 90, 92 essentially parallel in each set which extend inwards from the edge 94 of the reinforcement 88 and there end on a slot-free area 96 of the reinforcement 88 which essentially has the form of an "X" curved inwards at both sides. In other words, in the embodiment shown, the slots 90 of each set of slots 90 at their inner end are delimited by an imaginary circle arc K90 (in FIG. 5 shown only for the left-hand side) drawn about a center point M lying on the axis BK. An imaginary circle arc K92 drawn about the same center point M with a larger radius and running through the center Z of the reinforcement 88 limits the adjacent outer slots 92 of the two other sets of slots 92. In FIG. 5 figures BK and ZK also indicate the alignment of the reinforcement 88 in relation to the base curve or cylinder curve of the toric surface F to be fine machined.

In the embodiment according to FIG. 6 a reinforcement 88 is also provided. Also the membrane 14 in this embodiment has an elastic intermediate layer 98 which is applied to the side of the machining section 16 facing away from the pressure medium chamber 40 above the reinforcement 88 on the machining section 16 of the membrane 14 by means of a suitable adhesive and has the same outer diameter as the machining section 16. The intermediate layer 98 here is comprised of a PUR (polyurethane) foam (e.g. Aclacell® by Aclawerken) and has a Shore A hardness of 35 to 60, preferably 45 to 50. This intermediate layer 98 is primarily intended for the fine machining of free form surfaces so that here transitions between surface areas of different geometry can be polished out cleanly.

Finally FIG. 6 shows a thin a layer 100 between the intermediate layer 98 and the polishing compound carrier 58. This layer 100, which is comprised of a rubber material with a Shore A hardness of approximately 60 to 70 and is again attached by means of a suitable adhesive, serves to promote the adhesion between the intermediate layer 98 and the polishing compound carrier 58.

A tool is disclosed for fine machining of optically active surfaces, with a base body that can be attached to a tool spindle of a machine tool, and an elastic membrane that has a machining section to which connects a gaiter section by means of which the membrane is attached to the base body such that it can be rotated therewith. The base body and the membrane delimit a pressure medium chamber which via a channel can be optionally pressurized with a pressure medium in order to apply a machining pressure via the machining section during machining of the optically active surface. A guide element guided longitudinally mobile on the base body is actively connected with the machining section so that the machining section can be moved in the longitudinal direction of the guide element and held in the transverse direction to the guide element, although under an elastic deformation of the gaiter section it is tilt-mobile in relation to the guide element. The result is a tool of simple design and reliable function which has an excellent adaptability to a wide range of geometries to be machined.

Variation and modification are possible without departing from the scope and spirit of the invention which is defined in the appended claims.

We claim:

1. A tool (10) for fine machining of optically active surfaces (F), in particular free form surfaces and toric surfaces on spectacle lenses (L), comprising a base body (12) that can be attached to a tool spindle of a machine tool, an elastic membrane (14) with a machining section (16) followed by a gaiter section (18) by means of which the membrane (14) is attached to the base body (12) so that it can be rotated therewith, a pressure medium chamber (20) delimited by the base body (12) and the membrane (14) which can be pressurized selectively with a pressure medium via a channel (22) in order during the machining of the optically active surface (F) to exert a machining pressure via the machining section (16), and a guide element (24) guided longitudinally displaceable on the base body (12) and actively connected with the machining section (16) of the membrane (14) so that the machining section (16) is mobile in the longitudinal direction of the guide element (24) and held in the transverse direction to the guide element (24), although under an elastic deformation of the gaiter section (18) it is tilt-mobile in relation to the guide element (24).

2. Tool (10) according to claim 1, wherein the machining section (16) of the membrane (14) is preformed essentially spherical.

3. Tool (10) according to claim 2, wherein the gaiter section (18) has at least two, preferably three folds (56).

4. Tool (10) according to claim 3, wherein the membrane (14) is comprised of an elastomer material composed substantially from NBR, EPDM or PUR with a Shore A hardness of 45 to 70.

5. Tool (10) according to claim 4, wherein the machining section (16) of the membrane (14) is stiffened by means of an areal reinforcement (88).

6. Tool (10) according to claim 5, wherein the reinforcement (88) is preformed essentially spherical.

7. Tool (10) according to claim 6, wherein the reinforcement (88) is vulcanized onto the machining section (16) on the side of the machining section (16) of the membrane (14) facing away from the pressure medium chamber (20).

8. Tool (10) according to claim 7, wherein the reinforcement (88) is comprised of a plastically deformable metallic sheet section, in particular a sheet section of a TiZn alloy.

9. Tool (10) according to one of the claim 8, wherein the reinforcement (88) has different flexional rigidities in two planes running perpendicular to each other.

10. Tool (10) according to claim 9, wherein the reinforcement (88) in cross-like arrangement has four sets of slots (90, 92) essentially parallel in each set, which extend inwards from the edge (94) of the reinforcement (88) and there end at a slot-free area (96) of the reinforcement (88) which essentially has the form of an "X" curved inwards on both sides.

11. Tool (10) according to claim 1, wherein an elastic intermediate layer (98) is applied to the machining section (16) of the membrane (14) on the side facing away from the pressure medium chamber (20).

12. Tool (10) according to claim 11, wherein the intermediate layer (98) is comprised of a PUR foam.

13. Tool (10) according to claim 11, wherein the intermediate layer (98) has a Shore A hardness of 35 to 60.

14. Tool (10) according to claim 1, wherein the guide element (24) is formed by a pin which is guided longitudinally displaceable in a receiving bore (66) in the base body (12).

15. Tool (10) according to claim 14, wherein between the guide element (24) and the base body (12) are provided means for friction reduction.

16. Tool (10) according to claims 15, wherein the receiving bore (66) in the base body (12) is fitted with at least one grease pocket (68) as a means of friction reduction.

17. Tool (10) according to claim 14, wherein the guide element (24) is actively connected with the machining section (16) of the membrane (14) via a ball head (70) held swivellable in a ball socket (76).

18. Tool (10) according to claim 17, wherein the ball socket is formed by a shaped part (78) that is engaged in an undercut receiving chamber (64) formed on the machining section (16) of the membrane (14) on the side facing the pressure medium chamber (20).

19. Tool (10) according to claim 18, wherein the receiving chamber (64) on the machining section (16) of the membrane (14) communicates with the channel (22) for pressurization of the pressure medium chamber (20) via a channel (84) extending through the ball head (70).

20. Tool (10) according to claim 14, wherein the channel (22) for pressurization of the pressure medium chamber (20) is formed in the guide element (24).

21. Tool (10) according to claim 17, wherein the channel (22) has a longitudinal bore (80) in the guide element (24) which communicates with the pressure medium chamber (20) via a transverse bore (82) in the guide element (24).

22. Tool (10) according to claim 1, wherein the channel (22) for pressurization of the pressure medium chamber (20) is formed in the guide element (24).

23. Tool (10) according to claim 22, wherein the channel (22) has a longitudinal bore (80) in the guide element (24) which communicates with the pressure medium chamber (20) via a transverse bore (82) in the guide element (24).

24. Tool (10) according to claim 1, wherein the guide element (24) is actively connected with the machining section (16) of the membrane (14) via a ball head (70) held swivellable in a ball socket (76).

25. Tool (10) according to claim 24, wherein the ball socket is formed by a shaped part (78) that is engaged in an undercut receiving chamber (64) formed on the machining section (16) of the membrane (14) on the side facing the pressure medium chamber (20).

26. Tool (10) according to claim 25, wherein the receiving chamber (64) on the machining section (16) of the membrane (14) communicates with the channel (22) for pressurization of the pressure medium chamber (20) via a channel (84) extending through the ball head (70).

* * * * *